US005743804A

United States Patent [19]

Bacon

[11] Patent Number: 5,743,804

[45] Date of Patent: Apr. 28, 1998

[54] HANDS-FREE GOLF BALL TEEING DEVICE

[76] Inventor: Gary E. Bacon, 10772 Pine St., Los Alamitos, Calif. 90720

[21] Appl. No.: 814,202

[22] Filed: Mar. 11, 1997

[51] Int. Cl.[6] ..... A63B 57/00

[52] U.S. Cl. ..... 473/132; 473/137

[58] Field of Search ..... 473/132–137, 473/278, 279, 386

[56] References Cited

U.S. PATENT DOCUMENTS

| | | | |
|---|---|---|---|
| 2,171,299 | 8/1939 | Beckett | 473/137 |
| 3,510,136 | 5/1970 | Ruspoli | 473/137 |
| 3,586,335 | 6/1971 | D'Antonio, Sr. | 473/278 |
| 5,383,668 | 1/1995 | Andrikian | 473/132 |

*Primary Examiner*—Steven B. Wong
*Attorney, Agent, or Firm*—Albert O. Cota

[57] ABSTRACT

A hands-free golf ball teeing device (10) which allows a golfer to tee a golf ball, at a driving range, without having to bend over or to squat down to place the ball on the tee. The device (10) consists of a base (12) from where extends upward a structure (20). The structure (20) incorporates on one side a ramp channel (40) to which is pivotally attached a golf ball ramp (50) which includes a golf ball retaining bore (96) and a longitudinal golf ball channel (98). On the opposite side of the structure (20) is a lever plate (130). To operate the device (10) the lever plate (130) is depressed, with a golf club or the like, which then applies a force to the lower surface (62) of the golf ball ramp (50). This force is sufficient to overcome the magnetic force supplied by two permanent magnets (120,122) which are positioned to maintain the ramp (50) in a lowered position. When the ramp is in the raised position, a golf ball is easily guided up the channel (40) on the golf ball ramp (50) and into the golf ball retaining bore (96). Pressure from a golf club is then applied to the upper surface (60) of the ramp (50) to allow the ramp to be placed in the lowered position. At this time, the golf ball (170) is situated on top of the tee (150) ready to be struck by a golfer.

17 Claims, 3 Drawing Sheets

HANDS-FREE GOLF BALL TEEING DEVICE

TECHNICAL FIELD

The invention pertains in general to golf ball tees and more particularly to a golf ball tee which allows a golf ball to be placed upon a tee without the golfer having to bend over or squat down.

BACKGROUND ART

The sport of golf is one of the oldest known competitive sport events. During the last century, and especially in the past few years, golf has seen dramatic changes in how the general public perceives the sport. Our recent past stereotyped a typical golfer as a retirement-aged male, in gaudy, mis-matched clothes playing with a number of similarly dressed acquaintances. During the 1970's there were some professional golfers who tried to improve the image of golf but only recently, with the appearance of such professional golfers as Tiger Woods, has the sport begun to enjoy truly wide-spread popularity.

As a result of this increase in popularity, there has been an increase in the number of and types of golfing equipment and accessories. There are now special clubs available as well as almost any conceivable device that could improve a golfer's ability to play better. Although golf has become a more popular sport, with a more varied type of people playing, the golf industry has not forgotten that many older people were playing golf a long time ago and many continue to do so.

As a response to the high number of older players, many golf equipment companies strive to develop products that will assist older people with some of the actions that younger people are able to perform effortlessly. One typical example is the golf cart, whereas some golfers use a golf cart, as a matter of convenience, many older golfers would not be able to play if they were required to walk the entire distance of a course. There are other devices which also help older golfers yet unfortunately, there is still one action that all golfers must perform, no matter what their age may be. That action is the often repeated movement of bending down to place a ball on a tee. For a few of the golfers who are able to afford a caddy, this type of movement is not an issue. But, for the typical golfer, who must tee his/her own ball, this can quickly become a major difficulty.

Medical studies have shown that one of the most common problems of older people is that their backs become more easily strained. When this occurs it is all but impossible to even attempt to bend over and place a ball on a tee. Not to mention, how difficult it would be to try and perform this action over and over again during the span of a few hours.

Obviously, it can be seen that some type of device that assists golfers with placing a ball upon a tee, especially at a driving range, would be extremely beneficial and would increase the number of people who are able to golf.

A search of the prior art did not disclose any patents that read directly on the claims of the instant invention, however the following U.S. patents are considered related:

| U.S. Pat. No. | INVENTOR | ISSUED |
|---|---|---|
| 5,415,409 | Hellmann | 16 May 1995 |
| 5,411,267 | Burks, et al | 2 May 1995 |
| 5,326,107 | Park | 5 July 1994 |

The U.S. Pat. No. 5,415,409 Hellmann patent discloses an automatic teeing device that positions a golf ball on a tee.

The device provides a mechanism below a platform so that a golf ball can be hit from the tee by either righthand or lefthand hitters A golf ball gripping device allows a golf ball to be gripped and released and a feed chute feeds golf balls to a loading position under the platform.

The U.S. Pat. No. 5,411,267 Burks, et al patent discloses an automatic golf ball teeing apparatus, for use either indoors or outdoors, which can be installed above ground and requires no electricity, propellant or other remote power source for operation. The apparatus is capable of storing and sequentially dispensing by gravity a large number of golf balls to a tee unit of adjustable height.

The U.S. Pat. No. 5,326,107 Park patent discloses a golf ball storage and dispensing apparatus including a horizontally movable arm member. A housing covers the arm member in a retracted position and stores the golf balls. A guide wire supports a golf ball during movement of the arm member from the housing towards the tee. When the arm member is in a fully extended position, the arm member moves over the guide wire which releases the ball onto the tee.

For background purposes and as indicative of the art to which the invention is related reference may be made to the remaining cited patents.

| U.S. Pat. No. | INVENTOR | ISSUED |
|---|---|---|
| 5,458,339 | Wildes | 17 October 1995 |
| 5,383,659 | Taylor | 24 January 1995 |
| 5,016,886 | Gould | 21 May 1991 |
| 4,815,744 | Diamandis | 28 March 1989 |
| 4,360,199 | Jackson | 23 November 1982 |

DISCLOSURE OF THE INVENTION

Although golf is not one of the most strenuous sports or activities, there are still certain physical actions that must be performed while golfing that can cause stress on a person's body. One of these actions is bending over or squatting down to place a ball upon a tee. This action can cause severe back problems, among other injuries. This action becomes especially strenuous at locations such as a golf ball driving range. At a range, a golfer must almost continually keep placing a ball on a tee, which is necessary for each swing.

As a result of injuries related to placing a ball on a tee, or a golfer's inability to perform this act as he/she gets older, many golfers give up golf before they want to—or even really have to. The hands-free golf ball teeing device disclosed herein, is designed to alleviate this problem.

In its most basic design, the hands-free golf ball teeing device consists of:

a) a base, b) a structure that integrally extends upward from the base and that includes a ramp channel. The ramp channel has an open left end, a closed right end, and front and rear side walls. Near the open left end is located a golf ball tee that is attached by an attachment means, and c) a golf ball ramp having a front edge, a rear edge, a left edge, an open right edge, an upper surface, a lower surface, a golf ball retaining bore located inward from the left edge and that is over the golf ball tee, and a golf ball channel. The channel commences at the open right edge and terminates at an interface with the golf ball retaining bore. The golf ball ramp also includes a means for pivotally attaching the ramp to the ramp channel; a means for maintaining the ramp in a downward, closed position, in which position, the ramp is substantially flush with the upper surface of the structure, and a means for placing the ramp in an upward, raised position.

To use the device, the ramp is initially placed in the raised position; a golf club is then used to maneuver a golf ball up the golf ramp onto the golf ball retaining bore. The club is then used to apply pressure to the upper surface of the ramp to lower the ramp to its closed position at which time the ball is in position to be struck by the golfer.

In view of the above disclosure, it is the primary object of the invention to provide a hands-free golf ball teeing device which allows a golfer located on a golf driving range, without bending over or squatting, to place a golf ball on the driving range tee.

In addition to the primary object of the invention, it is also an object to product a device that:

can be manufactured in various types of materials, can be used as a stand-alone device or can be permanently installed on a driving range mat, can be configured in various geometric shapes i.e., a rectangle, a square, a circle, etc.

is reliable, requires no maintenance other than replacing a worn tee, and is cost effective from both manufacturing and consumer points of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
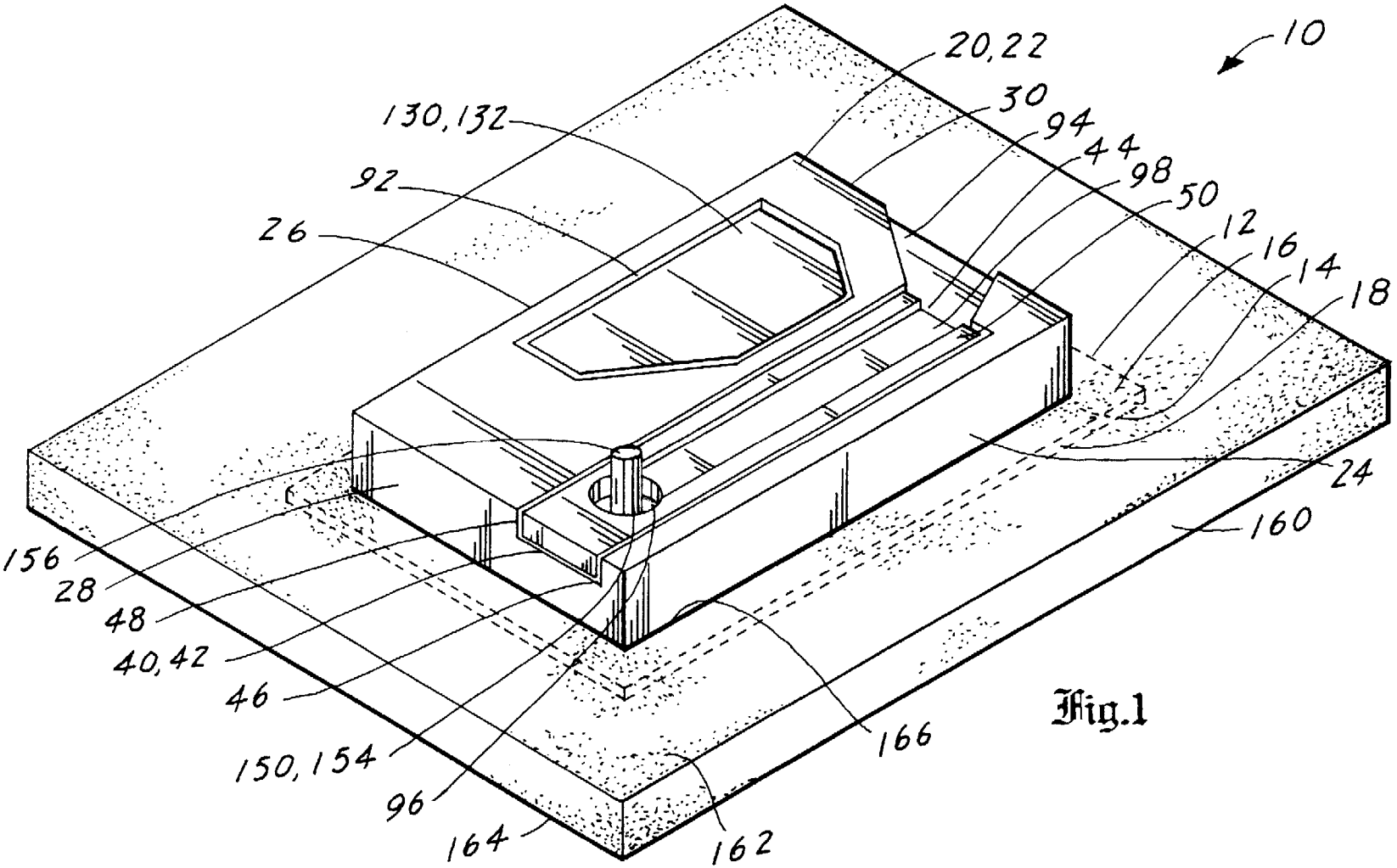
FIG. 1 is a perspective view of the hands-free golf teeing device shown with the golf ramp in its lowered position and the device inserted into a device containment mat.

The best mode for carrying out the invention is presented in terms of a preferred embodiment for a hands-free golf ball teeing device. When used, the teeing device provides a golfer the ability to have a ball placed upon a tee without having to bend over or squat down and place the ball on the tee. The teeing device is primarily designed to be used at a golf driving range, or other similar locations where there is no need to constantly re-locate the tee position.

The preferred embodiment of the hands-free golf ball teeing device 10, as shown in FIGS. 1–6, is comprised of the following major elements: a base 12; a structure 20 having a ramp channel 40 and a golf ball ramp 50; a lever cavity 92 and a lever plate 130. The device 10 is designed to be placed on the ground, at the preferred location for a golfer to swing at a golf ball 170.

Figure 3:
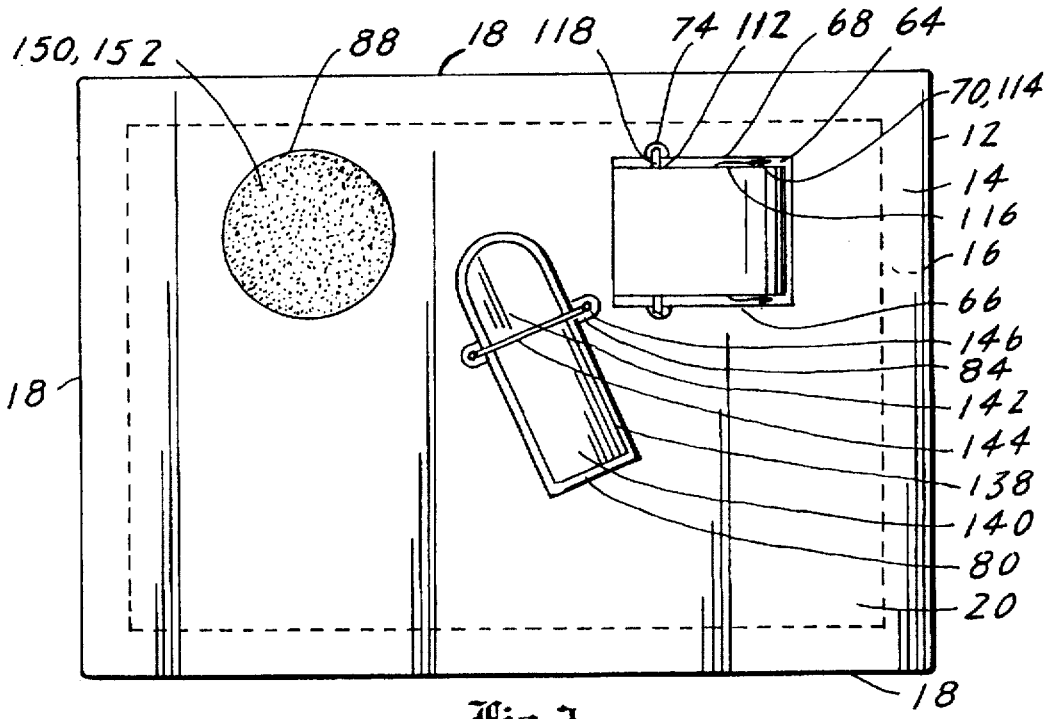
FIG. 3 is a bottom plan view of the device.

The base 12 consists of a lower surface 14, an upper surface 16 and side edges 18. Integrally attached to the base 12 is the structure 20. The structure 20 comprises an upper surface 22, a front edge 24, a rear edge 26, a left edge 28 and a right edge 30. Also within the structure 20, is the golf ball ramp 50. The ramp 50 has a front edge 52, a rear edge 54, a left edge 56, a right edge 58, an upper surface 60 and a lower surface 62. The ramp 50 is designed to be raised and lowered at an angle by the use of a spring/ramp pivot pin 114 and a pair of compression spring 116 as shown in FIG. 3. The pin 114 is inserted through the left edge 28 of the structure 20 and continues through the ramp 50, via a pair of spring/rod pivot bores 70, which are located at the rear edge 58 of the ramp 50. The compression spring 116, positioned around the pivot pin 114, causing the ramp 50 be biased in a raised position.

Figure 4:
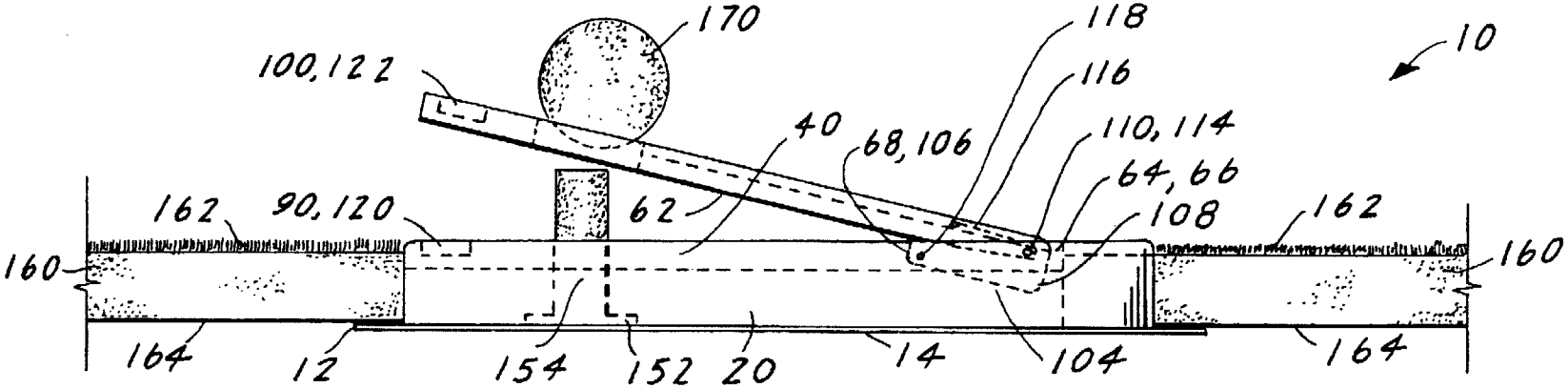
FIG. 4 is a front elevational view of the device showing the golf ball ramp in a raised position, the golf ball ramp in a lowered position, in broken lines, and the device inserted into a device containment mat.

On the lower surface 14 of the base 12 is located a ramp pivot opening 64 as shown in FIG. 3, which includes a rear edge 66 and a front edge 68. Near the front edge 68 are located two pivot rod attachment slots 84 which maintain the pivot pin 114 in a secure position. The pivot opening 64 as shown in FIG. 4, is designed to interface with the rear side wall 48 of the ramp channel 40.

Along the upper surface 60 of the ramp 50 is the ramp channel 40. The ramp channel 40 consists of a left end 42, a right end 44, a front side wall 46 and a rear side wall 48.

Figure 2:
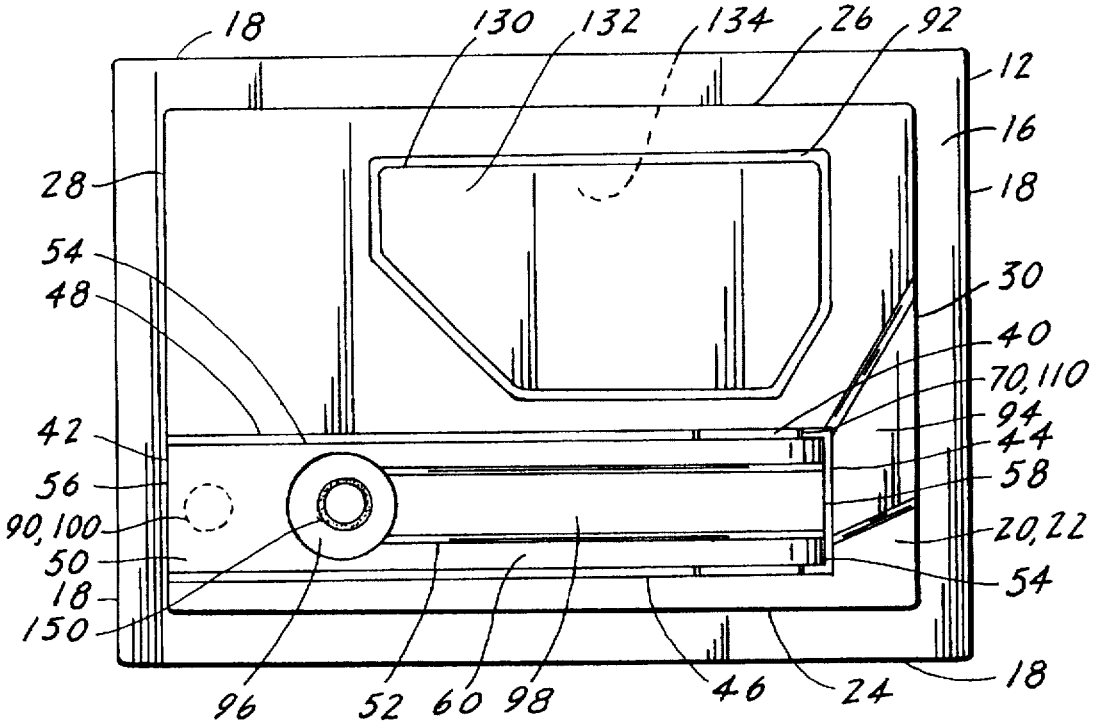
FIG. 2 is a top plan view of the device showing a golf ball, in broken lines, attached to the golf ball tee.

The channel 40 is used to hold the golf ball ramp 50 in position. In order to use the device 10 a golfer must roll a golf ball 170 up the ramp 50 along a golf ball channel 98 and place the ball upon the tee 150 as shown in FIGS. 2 and 4. In order to guide a golf ball onto the device 10 and up the golf ball channel 98, a channel entry 94 is used. The channel entry 94 is located on the right edge 30 of the structure 20 and is essentially, a slightly sloping, integral ramp.

Figure 5:
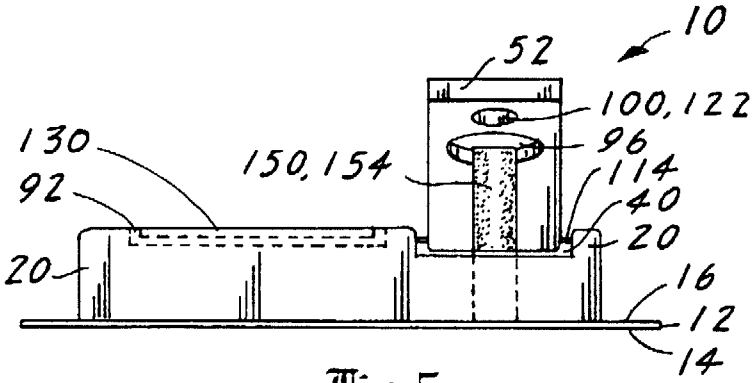
FIG. 5 is a left side elevational view showing the golf ball ramp in its raised position.

To raise the ramp 50 as shown in FIG. 5, a golfer must apply pressure onto the lever plate 130. The lever plate 130, as shown in FIGS. 1 and 2, consists of an upper surface 132 and a lower surface 134. The lever plate 130 is located within the lever cavity 92, which is integral, to the structure 20, with the upper surface 132 of the lever plate 130 substantially flush with the upper surface 22 of the structure 20.

When pressure is applied to the upper surface 132 of the lever plate 130, the lever plate 130 is depressed. Integrally attached to the lower surface 134 of the lever plate 130 is a pivot lever 138 as shown in FIG. 3. The pivot lever 138 which is located within a lever housing 80, consist of a first side 140, a second side 142 and a pivot bar 144. The pivot bar 144 is attached to the pivot lever 138 near the second side 142 and is maintained in position within pivot rod slots 146.

Once the lever plate 130 is depressed and the ramp 50 is raised, a ramp stop pin 118 causes the ramp 80 to stop its upward direction. The stop pin 118, as shown in FIG. 3, is inserted through a ramp stop bore 112 which is located on a protrusion 104. The protrusion consists of a left end 106 and a right end 108. The right end 108 is designed to be flush with the front 46 and rear 48 side walls of the ramp 50.

Once a golf ball has been rolled upward, along the ramp 50, the ball comes to rest within a golf ball retaining bore 96. The bore 96 is located inward from the left edge 56 of the ramp 50.

Located directly below the bore 96 is the tee 150. The tee 150 is constructed of a resilient material that is able to withstand an impact from a swinging club. The tee 150 is detachable from the device 10 and includes a base section 152 and an integral upward protruding section 154, which has a diameter that is smaller than the diameter of the base section 152. The length of the protruding section 154 may range from 1 inch to 3 inches. The tee 150 also has an upper end 156 which is dimensioned to hold a golf ball. The tee 150 is inserted through the lower surface 14 of the base 12 where the base section 152 fits into the larger diameter of a tee bore 88. The tee bore 88 is located forward of the lever housing 80 and extends through the ramp channel 40.

Figure 6:
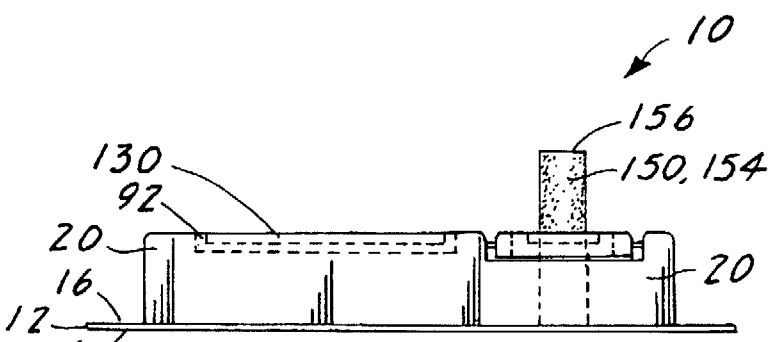
FIG. 6 is a right elevational view showing the golf ball ramp in its lowered position and a golf ball resting on the golf ball tee.

Before the ball is to be struck, the golfer must place the ramp 50 in the lowered position as shown in FIGS. 1 and 6. This is accomplished by simply applying downward pressure upon the ramp 50, until the ramp is completely lowered. Once the ramp 50 is lowered and the device 10 is positioned for use, two permanent magnets 120,122 maintain the ramp 50 in the lowered position.

The first permanent magnet 120, as shown in FIG. 4, is inserted into a channel magnet cavity 90 which is located within the ramp channel 40. The second permanent magnet 122 is inserted into a ramp magnet cavity 100 which is located within the ramp 50 as also shown in FIG. 4. As soon as the ramp 50 is in the fully lowered position, the two magnets 120,122 make contact and thus hold the ramp 50 in position within the ramp channel 40.

In order to provide a high degree of strength for the device 10, the structure 20, the ramp 50 and the lever plate 130 are all molded from a high impact plastic such as polyurethane. The lower surface 14 of the base 12 may also be covered with a moisture resilient material (not shown), which may be attached or detached, depending on the condition of the surface on which the device 10 is placed.

Additionally, a device containment mat 160, which is constructed of a resilient material, such as artificial turf, is included to be attached onto the device 10 as shown in FIGS. 1 and 4. The mat 160 comprises an upper surface 162, a lower surface 164 and an opening 166. The opening 166 is dimensioned to allow the structure 20 to be inserted into the opening 166 from the lower surface 104. The upper surface 16 of the base 12 is in contact with the lower surface 164 and the upper surface 22 of the structure 20 is substantially flush with the upper surface 162.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

I claim:

1. A hands-free golf ball teeing device comprising a base from where extends upward a structure, with said structure having:

a) an upper surface and a ramp channel, with said ramp channel having an open left end, a closed right end and front and rear side walls, where near the open left end is located a golf ball tee attached by an attachment means, and b) a golf ball ramp having a front edge, a rear edge, a left edge, an open right edge, an upper surface, a lower surface, a golf ball retaining bore located inward from the left edge and over said golf ball the and a golf ball channel that commences at the open right edge and terminates at an interface with said golf ball retaining bore, a means for pivotally attaching said ramp to said ramp channel, a means for maintaining said ramp in a lowered position where said ramp is substantially flush with said structure, and a means for placing said ramp in a raised position, wherein to use said device, said ramp is initially placed in the raised position, a golf ball is then maneuvered up the golf ramp onto said golf ball retaining bore, the ramp is then lowered, at which time the ball is in position to be struck by the golfer.

2. The device as specified in claim 1 wherein said base and structure are integrally molded of a high impact plastic.

3. The device as specified in claim 1 wherein said high impact plastic is comprised of a polyurethane.

4. The device a specified in claim 1 wherein said means for attaching said golf ball tee to the ramp channel comprises a tee bore located near the open left end of said ramp channel into which is inserted said golf ball tee wherein said means allows a broken or worn tee to be easily removed and replaced.

5. The device as specified in claim 1 wherein said means for pivotally attaching said golf ball ramp to said ramp channel comprises a spring/ramp pivot pin which is located near the rear edge of said golf ball ramp and inserted into respective spring/pivot bores located on the front and rear side walls of said ramp channel.

6. The device as specified in claim 5 wherein said means for maintaining said golf ball ramp in a lowered position comprises:

a) said ramp channel having near the open left end a channel magnet cavity into which is inserted a first permanent magnet, and b) said golf ball ramp having near the left edge and lower surface a ramp magnet cavity into which is inserted a second permanent magnet, wherein when said first and second permanent magnets interface, the golf ramp remains attached to the ramp channel in the lowered position.

7. The device as specified in claim 6 wherein said means for placing said golf ball ramp in a raised position comprises a compression spring which is positioned around said spring/ramp pivot pin wherein said spring biases said golf ramp in the raised position and function in combination with a pivot lever that is operated by a lever plate which is accessible from the upper surface of said structure, wherein said pivot lever produces an upward pressure on the lower surface of said golf ball ramp when said lever plate is depressed, wherein the upward pressure produced is sufficient to overcome the magnetic force of the first and second permanent magnets and cause said golf ball ramp to pivot to the raised position.

8. The device as specified in claim 3 wherein said means for maintaining said golf ball ramp in the raised position comprises:

a) a ramp stop pin inserted through a lateral ramp stop bore located near the right edge of said golf ball ramp wherein said pin is dimensioned to extend outward from each side of said golf ball ramp, and b) a pair of ramp stop slots located on said structure in alignment with said ramp stop pin wherein when said compression spring biases said golf ramp in the raised direction, the travel in the upward direction is stopped when the ramp stop pin interfaces with the ramps stop slots.

9. A hands-free golf ball teeing device comprising:

A. a base having a lower surface, an upper surface, and side edges,

B. a structure which integrally extends upward from the upper surface of said base and inward from the side edges of said base, said structure having:

a) an upper surface, a front edge, a rear edge, a left edge and a right edge, b) a ramp channel having:

(1) an open left end located at the left edge of said structure, a closed right end that terminates near the right edge of said structure, a front side wall and a rear side wall, (2) a ramp pivot opening having a rear edge that interfaces with the rear side wall of said ramp channel and a front edge that terminates near the front side wall of said ramp channel, (3) a spring/ramp pivot bore located near the rearward end of said ramp channel and through the front and rear side walls of said ramp channel, (4) a ramp stop slot located near the front edge of said ramp pivot opening and the front and rear side walls of said ramp channel, (5) a lever housing located adjacent the front side wall of said channel, wherein said housing extends downward through said structure and said base, and wherein said housing is elongated at the structure and base levels and includes along the sides a pair of pivot rod attachment slots, (6) a tee bore located forward of the lever housing and extending through said ramp channel, said structure and said base, wherein the diameter of said tee bore is larger at said base, (7) a channel magnet cavity located forward of said tee bore and near the open forward end of said channel, (8) a lever cavity located between the rear side wall of said ramp channel and the left, right and rear edges of said structure, (9) a channel entry which commences at the right edge of said structure and terminates at the rearward end of said ramp channel, C. a golf ball ramp having:

a) a front edge, a rear edge, a left edge, a right edge, an upper surface and a lower surface, b) a golf ball retaining bore located inward from the left edge, c) a golf ball channel that commences at the right edge and terminates at an interface with said golf ball retaining bore, d) a ramp magnet cavity located on the lower surface, near the left edge and in alignment with the channel magnet cavity on said ramp channel, e) a protrusion having a left end, a right end and front and rear sides that are flush with the front and rear side walls of said ramp, wherein said right end of said protrusion is flush with the right edges of said ramp and wherein said protrusion extends downward from the lower surface of said ramp with said protrusion having near the right end a lateral spring/ramp pivot bore and having near the left end a lateral ramp stop bore, D. a spring/ramp pivot pin inserted through said spring/ramp pivot bore on said protrusion and into the spring/ramp pivot bores on said ramp channel, wherein said pivot pin allows said golf ball ramp to pivot about said pivot pin, E. a compression spring positioned around said spring/ramp pivot pin and located between said golf ball ramp and said ramp channel wherein said spring biases said ramp in a raised position, F. a ramp stop pin inserted through said lateral ramp stop bore on said protrusion wherein said pin is dimensioned to extend outward from each side of said protrusion and to fit into the respective ramp stop slot on said structure wherein when said compression spring biases said golf ramp in the raised direction the travel in the upward direction is stopped when the ramp stop pin interfaces with the ramp stop slots on said structure, G. a first permanent magnet inserted into said channel magnet cavity and a second permanent magnet inserted into said ramp magnet cavity wherein when the two magnets interface, the pivotal golf ball ramp is maintained in a lowered position, H. a lever plate having an upper surface and a lower surface wherein said plate is dimensioned to fit into the lever cavity on said structure, I. a pivot lever having a first side, a second side and a pivot bar that is attached across the lever with ends that extend outward from the sides of said lever, wherein the first side of said lever is attached to the lower surface of said lever plate and the second side is dimensioned to freely travel within the elongated lever housing on said structure and said base and wherein the outward extending pivot bars are attached to the respective pivot rod slots on said structure, wherein when said lever plate is depressed, the second side of the lever makes contact with and places a sufficient pressure, on the lower surface of said golf ball ramp, to overcome the magnetic force of said first and second magnets, and allow the golf ball ramp to pivot to the raised position, and J. a detachable, resilient tee having a base section and an integral upward protruding section having a diameter that is smaller than the diameter of the base section and having an upper end dimensioned to hold a golf ball, wherein said tee is inserted from the lower surface of the base where the base section fits into the larger diameter of the tee bore and the upward protruding section extends upward through the tee bore and further extends through the golf ball retaining bore on said pivotal golf ball ramp, wherein when said device is positioned for use, said two permanent magnets maintain said pivotal golf ramp in the lowered position, a golf ball is placed on the upper end of said tee and a golf club is used to hit the ball away from said device, wherein after hitting the ball the lever plate is depressed with a golf club which causes said ramp to be released from the magnetic force of said first and second magnets and move into its raised position, a golf ball is then guided by a golf club into said ball-entry channel, up said ramp channel until the ball is situated a top the golf ball retaining bore, the golf ball ramp is then pressed downward with a golf club until said two magnets interface to hold said golf ball ramp in its lowered position at which time the golf ball remains resting on the golf tee awaiting a swing.

10. The device as specified in claim 9 wherein said structures said ramp and said plate are molded from a high impact plastic.

11. The device as specified in claim 10 wherein said high-impact plastic comprise a polyurethane.

12. The device as specified in claim 9 wherein said tee is constructed of a resilient material that is able to withstand an impact from a swinging golf club.

13. The device as specified in claim 9 wherein the lower surface of said base is covered with a moisture resistant material, wherein said cover having an opening over the tee section which allows said tee to be removed and replaced as needed.

14. The device as specified in claim 13 wherein said material having means for being attached and detached.

15. The device as specified in claim 9 further comprising a device containment mat having:

a) an upper surface and a lower surface, and b) an opening dimensioned to allow said structure to tightly fit into said opening, wherein when said structure is inserted into said opening from the lower surface of said mat, the upper surface of said base is in contact with the lower surface of said mat and the upper surface of said structure is substantially flush with the upper surface of said mat.

16. The device as specified in claim 15 wherein said mat is constructed from artificial turf.

17. The device as specified in claim 15 wherein said mat is constructed from a resilient material.

* * * * *